United States Patent [19]

Mori et al.

[11] Patent Number: 4,652,707

[45] Date of Patent: Mar. 24, 1987

[54] POWER SWITCH

[75] Inventors: Teijiro Mori; Yuichi Wada, both of Hyogo; Shizutaka Nishizako, Aichi; Masahiro Kakizoe, Aichi; Shigeru Masuda, Aichi, all of Japan

[73] Assignee: Mitsubishi Denki Kabushiki Kaisha, Tokyo, Japan

[21] Appl. No.: 768,092

[22] PCT Filed: Dec. 7, 1984

[86] PCT No.: PCT/JP84/00577

§ 371 Date: Aug. 7, 1985

§ 102(e) Date: Aug. 7, 1985

[87] PCT Pub. No.: WO85/02710

PCT Pub. Date: Jun. 20, 1985

[30] Foreign Application Priority Data

Dec. 7, 1983 [JP] Japan ..... 58-231135
Mar. 19, 1984 [JP] Japan ..... 59-53105

[51] Int. Cl.[4] ..... H01H 33/20
[52] U.S. Cl. ..... 200/144 R; 200/147 R
[58] Field of Search ..... 200/144 R, 147 R

[56] References Cited

U.S. PATENT DOCUMENTS 4,477,704 10/1984 Mori et al. ..... 200/144 R
4,521,655 6/1985 Okado et al. ..... 200/147 R

*Primary Examiner*—Robert S. Macon
*Attorney, Agent, or Firm*—Sughrue, Mion, Zinn, Macpeak and Seas

[57] ABSTRACT

A power switch includes a fixed contact member 13 to which a fixed contact 14 is joined, a movable contact member 5 to which there is joined a movable contact 6 movable into and out of contact with the fixed contact 14 of the fixed contact member 13, a commutation electrode 3 for transferring an arc generated when the fixed contact 14 and the movable contact 6 are separated, and a grid 2 for extinguishing the arc transferred on the commutation electrode 3, the commutation electrode 3 having a recess 17 for allowing the movable contact 6 to move out of contact with the fixed contact 14 and so that the movable contact member 5 can move toward the fixed contact member 13, the commutation electrode 3 having an end extending parallel to the grid 2 and a slit 16, 19 extending continuously from the recess 17 to a portion parallel to the grid 2. The arc generated when the movable contact 6 is separated from the fixed contact 14 can be transferred at high speed toward the slit 16, 19 by a current produced in the commutation electrode 3.

4 Claims, 11 Drawing Figures

POWER SWITCH

TECHNICAL FIELD

The present invention relates to a power switch such as an electromagnetic contactor, and more particularly to an improvement in a commutation electrode thereof.

As shown in FIGS. 1(*a*) and 1(*b*), a conventional electromagnetic contactor has a commutation electrode 3 disposed around an end of a movable contact member 5 to which a movable contact 6 is joined. FIGS. 2(*a*) and 2(*b*) illustrate a fixed contact member 13 disposed in confronting relation to the movable contact member 5 and an arc rubber 15 attached to the fixed contact member 13. A fixed contact 14 is joined to the fixed contact member 13. The movable contact 6 of the movable contact member 5 is movable into and out of contact with the fixed contact 14.

The movable contact member 5 has an intermediate portion connected to a known electromagnetic drive device. The movable contact 6 is joined to each end of the movable contact member 5, and the fixed contact members 13 are provided respectively for the movable contacts 6.

FIGS. 1(*a*) and 1(*b*) are perspective and enlarged fragmentary plan views, respectively, schematically showing the commutation electrode 3, the movable contact member 5, and the movable contact 6. The fixed contact member 13, the fixed contact 14, and the arc runner 15 in FIGS. 1(*a*) and 1(*b*) are schematically shown in FIGS. 2(*a*) and 2(*b*) at an enlarged scale.

In the conventional electromagnetic contactor having the commutation electrode 3, when the fixed contact 14 and the movable contact 6 are separated, an end of an arc generated between these contacts is transferred from the movable contact 6 to the commutation electrode 3, while the other arc end is transferred from the fixed contact 14 to the arc runner 15. The transferred other end of the arc is moved on the arc runner 15 toward the other end thereof until finally the arc is extinguished between the parallel portion of the arc runner 15 and the commutation electrode 3 confronting the same.

With the commutation electrode 3 in the conventional electromagnetic contactor being shaped as shown in FIGS. 1(*a*) and 1(*b*), when an arc leg is produced at a position P as shown in FIGS. 1(*a*) and 1(*b*), current components i1, i2 flowing from the commutation electrode 3 into the arc legs are of substantially the same value, and an arc current is equal to the sum i of the current components i1, i2 ($i=i1+i2$). In FIG. 1(*b*), the commutation electrode 3 has a prescribed thickness (though it is omitted from illustration in FIG. 1(*a*)) across its width. In FIG. 1(*b*), l1, l2 denote the distances from the ends of the commutation electrode 3 to the position P where the arc is produced. Since the force F1 imposed by the current i1 on the arc is larger than the force F2 imposed by the current i2 on the arc, the arc is driven in the direction of the force F which is the combination of the forces F1, F2. Therefore, the arc is brought into direct contact with an arc box of synthetic resin accommodating the commutation electrode 3 and the movable contact member 5, thus leaving great damage on the arc box.

DISCLOSURE OF THE INVENTION

Accordingly, it is an object of the present invention to provide a power switch having a prescribed recess (slit) for preventing an arc box from being damaged.

BEST MODE FOR CARRYING OUT THE INVENTION

Embodiments of the present invention will be described hereinbelow.

Figure 2A:
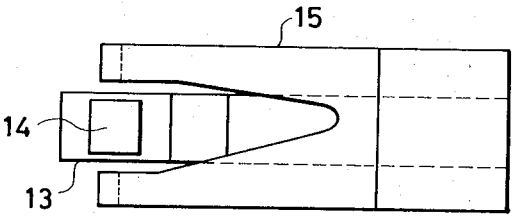
FIGS. 2(*a*) and 2(*b*) are enlarged fragmentary views of a fixed contact member and an arc runner of the conventional electromagnetic contactor.
Figure 2B:
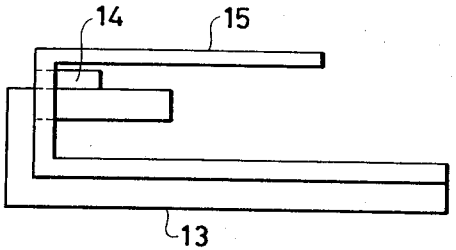
Figure 1A:
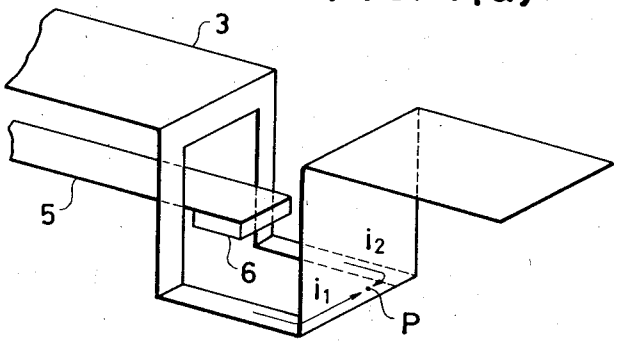
FIGS. 1(*a*) and 1(*b*) are enlarged fragmentary views of a movable contact member and a commutation electrode, the view showing a conventional electromagnetic contactor.
Figure 1B:
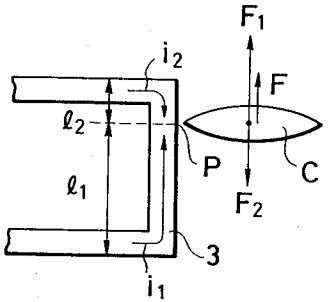
Figure 3:
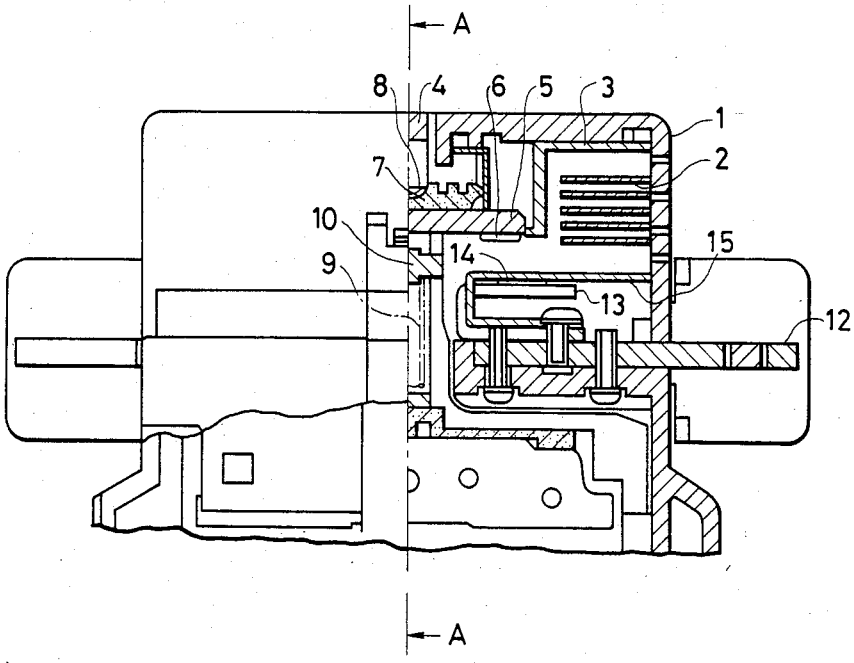
FIG. 3 is a side elevational view, partly in cross section, of an electromagnetic contactor according to an embodiment of the present invention.
Figure 4:
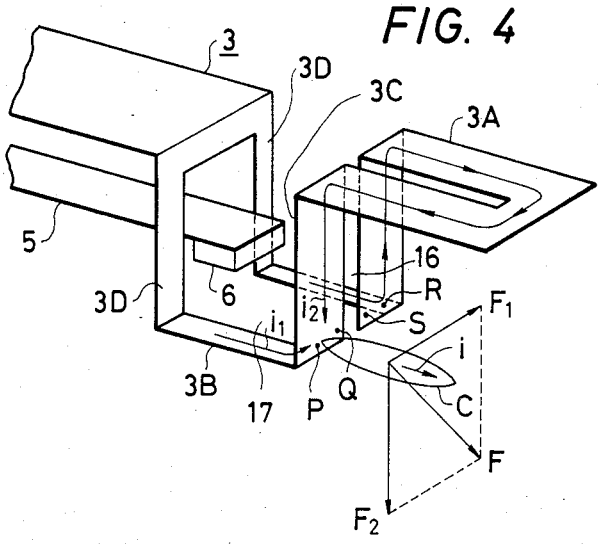
FIG. 4 is a fragmentary perspective view of a commutation electrode and a movable contact member of the electromagnetic contactor of the invention.

FIGS. 3 and 4 illustrate an embodiment in which the present invention is applied to an electromagnetic contactor. Designated at 1 is an arc box made of a heatresistant material for extinguishing arcs. As many grids 2 and commutation electrodes 3 of magnetic metal as there are the phases of circuits to be opened and closed are disposed in and fixed to the arc box 1. Denoted at 4 is a cross bar, 5 a movable contact member, 6 a movable contact attached to each end of the movable contact member 5, 7 a holder for the movable contact member, 8 a holder spring support, 9 a contact member spring, and 10 a stopper. The contact member spring 9 is disposed under compression between the lower portion of the stopper 10 and the holder spring support 8. The holder spring support 8 is held against the upper surface of the movable contact member holder 7, and the upper surface of the movable contact member 5 is held against the lower surface of the movable contact member holder 7. Designated at 12 is a terminal fastened by screws or the like to a fixed contact member 13 to which a fixed contact 14 is joined. The movable contact member is connected through the contact member spring 9 to a known built-in electromagnetic drive device (not shown).

Such contact mechanisms are disposed symmetrically with respect to the cross-sectional plane A—A. There are as many contact mechanisms as the number of phases of circuits to be opened and closed, the contact mechanisms being arranged in a direction normal to the sheet of the figures. Indicated at 15 is an arc runner, and 16 a slit defined from the lower end to the upper end of the commutation electrode 3 and having a prescribed length toward the righthand end as shown in FIG. 4. The commutation electrode 3 has a prescribed thickness though it is omitted from illustration in FIG. 4.

The commutation electrode 3 has at least four surfaces which will hereinafter be referred to as a first plate 3A, a second plate 3B, a third plate 3C, and a fourth plate 3D, respectively. The plates 3A, 3B, 3C, 3D used in the present invention are not limited to those having flat surfaces, but include those having curved surfaces, for example.

Designated at 17 is a large recess extending from the second plate 3B to the fourth plate 3D for allowing the movable contact member 5 to move therein. The slit 16 extends from the first plate 3C to the third plate 3A in contiguous relation to the recess 17.

When the contacts of the electromagnetic contactor are separated, an arc generated between the contacts is transferred to the second plate 3B of the commutation electrode 3 and the arc runner 15, and then moved from the second plate 3B onto the third plate 3C and goes on and along the third plate 3C and the arc runner 15. Finally, the arc C exists between the first plate 3A, the grids 2, and the arc runner 15. At this time, one leg of the arc C is positioned at a point P on the third plate 3C, and the other arc leg is located in a prescribed position (not shown) on the arc runner 15. A current related to the arc C flows in the direction of the arrow in FIG. 4. Denoted at i is an arc current, and $i=i1+i2$.

An arc driving force F1 due to the current i1 is generated laterally along a parallel portion of a vertical plate 3C of the commutation electrode 3 as illustrated. An arc driving force F2 due to the current i2 is generated downwardly along a vertical direction of the commutation electrode 3 as illustrated. The force F produced by combining the forces F1, F2 is necessarily directed toward wall of the arc box (which is normal to the commutation electrode 3 and adjacent to the side surface thereof) within a plane including the commutation electrode 3, for thereby moving the arc leg on the point P in a direction toward a point Q.

For the same reason, when an arc leg is transferred to a point R on the commutation electrode 3, an arc driving force generated by a current flowing through the commutation electrode 3 forcibly moves the arc leg from the point R to a point S.

As a consequence, the arc leg is moved in the vicinity of the slit 16 in the commutation electrode 3 without deviating therefrom, so that the arc will be prevented from contacting an arc box wall and hence from damaging the arc box.

While in the above embodiment the slit 16 is of a rectangular shape, the slit is not limited to such a shape.

With the embodiment of the invention as described above, the provision of the slit 16 in the commutation electrode is effective in preventing the arc from damaging the arc box 1.

Figure 5:
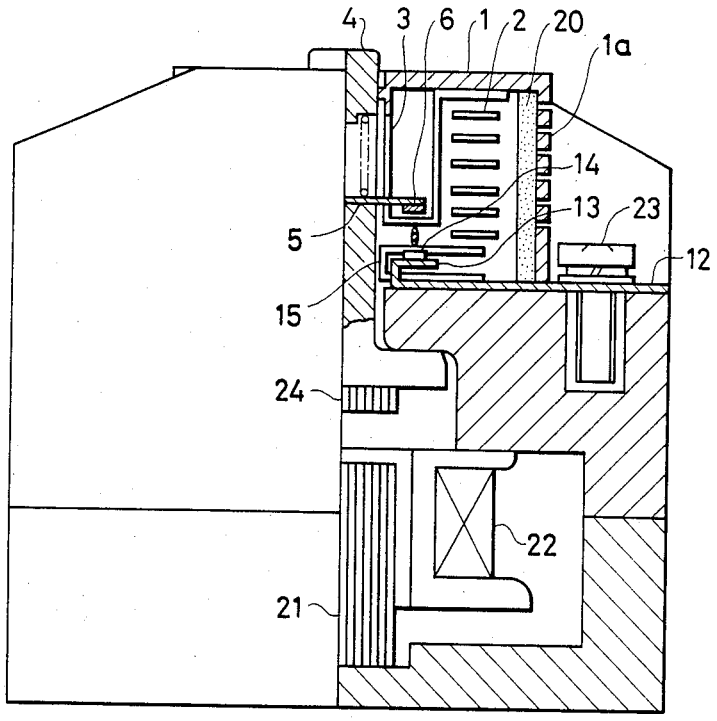
FIG. 5 is a righthand side elevational view, partly in cross section, of an electromagnetic contactor according to another embodiment of the present invention.
Figure 6:
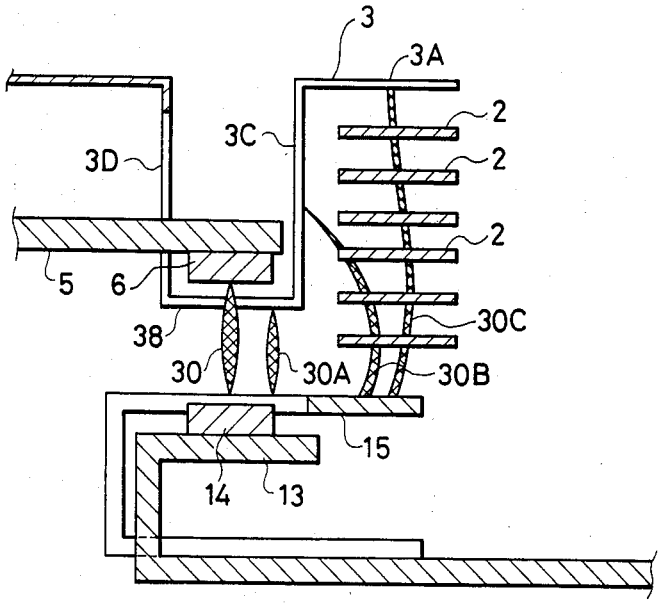
FIG. 6 is an enlarged fragmentary vertical cross-sectional view of the electromagnetic contactor of FIG. 5.
Figure 7:
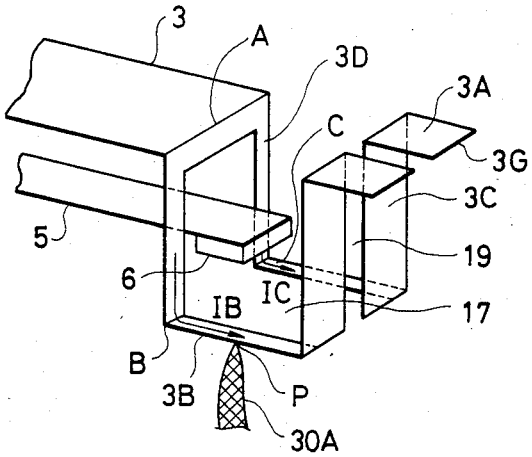
FIG. 7 is a view explanatory of operation of the arrangement illustrated in FIG. 6.

FIGS. 5 through 7 illustrate another embodiment in which the present invention is applied to an electromagnetic contactor.

Those parts which are idential to those shown in FIGS. 3 and 4 are denoted by identical reference characters. Denoted at 1*a* a are a number of holes defined in a side wall of an arc box 1, 20 a porous metal plate disposed in covering relation to the holes 1*a*, 21 a fixed laminated iron core composed of silicon steel plates, 22 a control coil for producing a driving force to attract a movable iron core 24 connected to a cross bar 4 against the spring force, and 23 a terminal screw mounted on a terminal 12 for connecting a wire.

The electromagnetic contactor shown in FIG. 5 is symmetrical in shape, and a right hand portion thereof is illustrated in cross section.

FIGS. 6 and 7 show the commutation electrode 3 at an enlarged scale. The commutation electrode 3 includes a first plate 3A extending parallel to the surface of a fixed contact 14 and spaced a prescribed distance from a fixed contact member 13 with grids 2 interposed between the first plate 3A and the fixed contact member 13, a second plate 3B extending parallel to the surface of the fixed contact 14 and positioned between the surface of a movable contact member 5 to which no movable contact 6 is joined and the fixed contact member 13 at the time the movable contact 6 and the fixed contact 14 are separated, a third plate 3C connecting the first and second plates 3A, 3B to each other, and a fourth plate 3D extending from the second plate 3B in the direction in which the movable contact 6 is separated from the fixed contact 14. The commutation electrode 3 also has a recess 17 defined in confronting relation to the movable contact member 5 and extending from the fourth plate 3D to the second plate 3B. Denoted at 19 is a slit extending from the recess 17, across the third plate 3C toward a free edge 3G of the first plate 3A to divide the first and third plates 3A, 3C into halves.

Circuit breaking operation will now be described. When the coil 22 shown in FIG. 5 is de-energized, the movable iron core 24 is separated from the fixed iron core 21 by a tripping spring (not shown) to separate the movable contact 6 from the fixed contact 14, whereupon an arc 30 is generated between the contacts 6, 14. The arc 30 is attracted to the grids 2 of a magnetic material and transferred between the commutation electrode 3 and the arc runner 15 under the magnetic field flowing through the movable contact member 5 and the fixed contact member 13, as shown at 30A in FIG. 6. The arc 30A is attracted by the magnetic grids 2 and driven by the magnetic field generated by the current flowing through the commutation electrode 3 and the arc runner 15, as shown at 30B. The arc 30B is then driven by the first plate 3A and the end of the arc runner 15, as shown at 30C, and the arc 30C is then extinguished. An arced gas produced when the arc is produced is cooled while passing through the pores in the porous metal plate 20, and is discharged out of the holes 1*a* in the arc box 1.

When one leg of the arc 30A is produced at a point A as shown in FIG. 7, there is no current IC flowing through a path ACP because of the slit 19, and all current flowing through the commutation electrode 3 flows through a path ABP as a current IB. Therefore, the arc 30A is forcibly driven to the right in FIG. 7 against being stuck at the point P. Since the arc 30A is driven at a high speed, the arcing time is shortened and the arc energy is reduced for increased circuit breaking performance.

Figure 8:
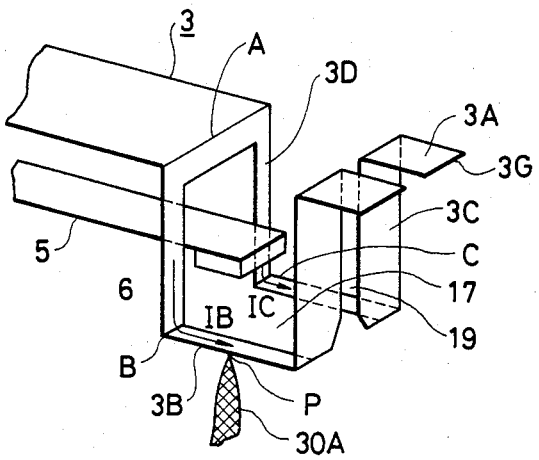
FIG. 8 is a fragmentary perspective view of another embodiment of the present invention, with a modified commutation electrode.

FIG. 8 is a perspective view of a commutation electrode and a movable contact member according to still another embodiment of the present invention. This embodiment differs from that of FIG. 7 in that the slit 19 is slightly wider in the third plate 3C adjacent to the second plate 3B. This arrangement has the same advantages as those of FIG. 7.

In the above embodiments, the present invention is applied to an electromagnetic contactor. However, the present invention is also applicable to a no-fuse circuit breaker.

Figure 9:
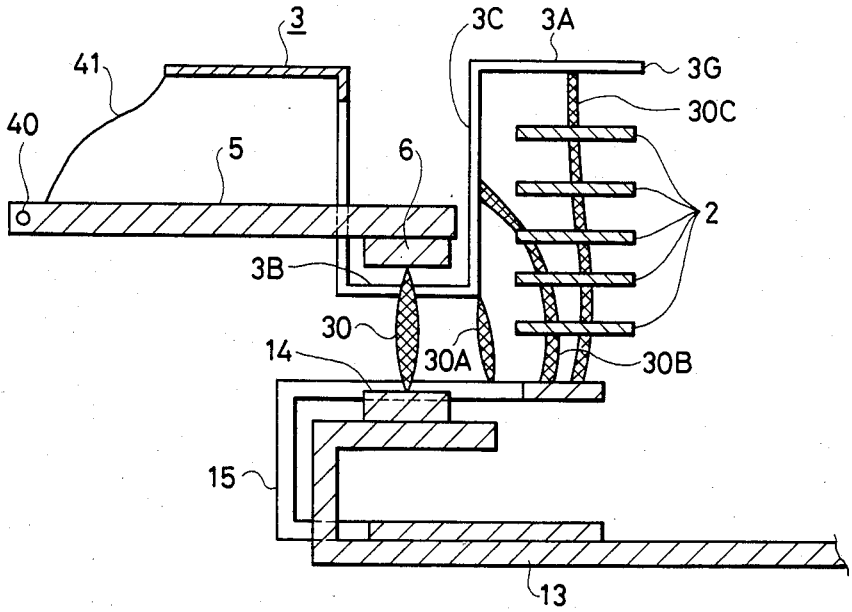
FIG. 9 is an enlarged fragmentary vertical cross-sectional view showing a nofuse circuit breaker to which the present invention is applied.

FIG. 9 is explanatory of a process of extinguishing an arc produced in a no-fuse circuit breaker to which the present invention is applied. Denoted at 40 is a shaft about which a movable contact member 5 is rotatable, and 41 a flexible stranded wire connecting a commutation electrode 3 to the movable contact member 5. The movable contact member 5 is rotatable about the shaft 40 for opening and closing the contacts 6, 14. Although not shown, the no-fuse circuit breaker is associated with an overcurrent detector and a control mechanism.

Operation will now be described. When an overcurrent flows, it is detected by the overcurrent detector which causes the control mechanism to separate the movable contact 6 from the fixed contact 14, producing an arc 30. The arc 30 is attracted to metal extinguishing plates 2 and driven by the magnetic field produced by a current flowing through the movable contact member 5 and the fixed contact member 13 so that the arc 30 is moved through 30A, 30B, and 30C and then extinguished by the metal extinguishing plates 2, a process which is the same as that employed in the embodiment shown in FIGS. 5 through 7. In FIG. 9, a slit 19 extends from a recess 17 through a third plate 3C to a free end 3G of a first plate 3A to divide the first and third plates 3A, 3C into halves. Therefore, for the same reason as that of the embodiment partly shown in FIGS. 5 through 7, the arc 30 can quickly be driven for increased circuit breaking performance. The slit 19 may be the same shape as that of the slit shown in FIG. 8.

While in each of the foregoing embodiments the recess 17 extends from the fourth plate 3D to the second plate 3B, it may extend from the fourth plate 3D through the second plate 3B to the third plate 3C for attaining the same advantages as those of the foregoing embodiments.

As described above, the slit extending from the recess through the third plate to the free end of the first plate to divide the first and third plates into halves is effective in quickly driving an arc generated between the contacts, with the result that the circuit breaking performance can be increased.

We claim:

1. A power switch comprising a fixed contact member (13) to which a fixed contact (14) is joined, a movable contact member (5) to which there is joined a movable contact (6) movable into and out of contact with the fixed contact for the fixed contact member, a commutation electrode (3) for transferring an arc generated when the fixed contact and the movable contact are separated, and a grid (2) for extinguishing the arc transferred on the commutation electrode, said commutation electrode having a recess (17) for allowing said movable contact to move out of contact with said fixed contact so that said movable contact member can move toward the fixed contact member, said commutation electrode having an end extending parallel to said grid and a slit (16, 19) extending continuously from the recess to a portion parallel to said grid, wherein said commutation electrode has a first plate (3A) extending parallel to the surface of said fixed contact and spaced a prescribed distance from said fixed contact member, a second plate (3B) extending parallel to the surface of said fixed contact and positioned between the surface of said movable contact member to which no movable contact is joined and said fixed contact member at the time said movable contact and said fixed contact are separated, a third plate (3C) connecting said first and second plates to each other, and a fourth plate (3D) extending from said second plate in the direction in which said movable contact is separated, said recess extending from said fourth plate to said second plate, said first plate being said portion parallel to said grid, said slit extending continuously from said recess through said third plate to said first plate.

2. A power switch according to claim 1, wherein said slit extends continuously from said recess to an end of said first plate to divide said third and first plates into halves.

3. A power switch according to claim 1, wherein said grid is made of a magnetic metal, there being a plurality of such grids.

4. A power switch according to claim 1, wherein said recess and said slit are defined centrally in said commutation electrode in the transverse direction thereof and extend from said fourth plate through said second and third plates to said first plate to divide these plates into two equal portions.

* * * * *